US011065555B2

(12) United States Patent
Patillo

(10) Patent No.: US 11,065,555 B2
(45) Date of Patent: Jul. 20, 2021

(54) STARTING BLOCKS FOR ATHLETE TRAINING

(71) Applicant: Kevin Patillo, Huber Heights, OH (US)

(72) Inventor: Kevin Patillo, Huber Heights, OH (US)

( * ) Notice: Subject to any disclaimer, the term of this patent is extended or adjusted under 35 U.S.C. 154(b) by 8 days.

(21) Appl. No.: 16/295,262

(22) Filed: Mar. 7, 2019

(65) Prior Publication Data

US 2020/0282325 A1 Sep. 10, 2020

(51) Int. Cl.
*A63K 3/02* (2006.01)

(52) U.S. Cl.
CPC ..... *A63K 3/023* (2013.01); *A63B 2225/02* (2013.01); *A63B 2225/09* (2013.01); *A63B 2225/50* (2013.01); *A63B 2230/00* (2013.01)

(58) Field of Classification Search
CPC ..... A63K 3/023; A63B 2225/50; A63B 2225/09; A63B 2230/00; A63B 2225/02; A63B 23/03591; A63B 21/4011; A63B 21/4017; A63B 22/20
See application file for complete search history.

(56) References Cited

U.S. PATENT DOCUMENTS

| | | | | |
|---|---|---|---|---|
| 2,523,159 | A | 11/1948 | Brouwer | |
| 4,611,803 | A * | 9/1986 | Newton, Jr. | A63K 3/023 482/19 |
| 4,754,965 | A | 7/1988 | Moye | |
| 5,616,102 | A * | 4/1997 | Lahmann | A63B 4/00 434/258 |
| 7,156,775 | B1 * | 1/2007 | Watry | A63K 3/023 254/390 |
| 9,242,187 | B2 | 1/2016 | Ford | |
| 9,630,056 | B2 * | 4/2017 | Rao | A63B 71/0054 |
| 2014/0221159 | A1 * | 8/2014 | Lawrence | A63K 3/023 482/8 |

FOREIGN PATENT DOCUMENTS

| | | | | |
|---|---|---|---|---|
| DE | 2507468 | A1 * | 9/1976 | A63K 3/02 |

* cited by examiner

*Primary Examiner* — Nyca T Nguyen
*Assistant Examiner* — Andrew M Kobylarz
(74) *Attorney, Agent, or Firm* — R. William Graham

(57) ABSTRACT

A starting blocks device includes a longitudinal member, a forward block removably connected to a forward part of the longitudinal member by way, and a rear block removably connected to a rear part of the longitudinal member and a sensor for determining force applied by the user.

19 Claims, 15 Drawing Sheets

STARTING BLOCKS FOR ATHLETE TRAINING

BACKGROUND OF THE INVENTION

Field of Invention

This invention relates to improvements in starting blocks for track athlete training. More particularly, the invention relates to a starting block training aid with sensed feedback.

Prior Art

Various prior starting blocks exist in the field of track and field. Some improve upon and simplify the structure to provide different front and rear starting blocks, and/or provide an adjustable foot rest such as will promote greater comfort by affording the proper degree of inclination, and to insure firm footing.

One example provides sets of blocks having front and rear foot rests having novel means for detachable association with the track whereby to permit the blocks to be arranged in a desirable longitudinally spaced relationship as well as in proper transverse spaced relationship.

Another example provides starting blocks for athletic events used interchangeably by runners who prefer to start with either the right or left foot forward which are easily adjustable for various starting positions and which provide solid abutments for the runners feet. Additionally, the starting blocks can be easily handled and moved about an athletic field and which occupy a minimum of space.

Still another example starting block device such as used by contestants in a foot-race on a track, for affording a good footing to the racer. The blocks are preset-inclined forward facing against the toes of the racers shoes. Another improvement in starting blocks center on a suction cup to secure the blocks in a fixed position on a flat floor.

While these have been improvements in the field, there remains a need to continue to improve the state of the art. The present invention lends such improvements to the art.

SUMMARY OF INVENTION

It is an object to provide an improved starting block for track and field athletes. It is another object to provide a starting block with a sensed feedback for detecting force of the user.

It is still another object to provide a starting block with a sensed feedback for detecting reaction time and starting line pressure of the user.

It is yet another object to provide a starting block with ease of transport for the user.

It is another object to provide a starting block which is easily adaptable to any floor surface.

Accordingly, one embodiment is directed to a starting blocks device which include a forward block removably connected to a forward longitudinal member by way of at least one, preferably two, bolt(s). A rear longitudinal member is hingedly connected to the forward longitudinal member. A rear block is removably connected to the forward longitudinal member by way of at least one, preferably two, bolt(s). The longitudinal members can be pivoted into axial alignment and a locking member is provided to fix the longitudinal members in place. Once so oriented, the forward block and rear block have starting faces, preferably formed with an incline, in which the user sets their feet against.

A handle can preferably be provided on starting locks device, such as on one of the longitudinal members to assist in carrying the device. Each of the blocks and longitudinal members has a respective bottom surface for disposal adjacent a floor or ground surface. Depending on the surface on which the surface is placed, the starting blocks device includes one of rubber, spiked or cleated material on at least one or more of the bottom surfaces to prevent slippage.

In another embodiment, there is provided pressure sensor on each block which senses the amount of force a user applies to the block. Additionally, the pressure sensor can provide a signal indicative of the start or reaction time of the user relative to the starting signal of an event. The sensor can be connected to a transmitter which transmits preferably wirelessly a data signal. A computer based application receives the data signal and transforms this data signal in the application to provide a readout of the sensed pressure/force and start/reaction time. Shock absorbers can be provided on the starting blocks to assist in the sensing of such pressure/force and start/reaction time. When the longitudinal members are collapsed the device is easier to handle and store.

Other objects and advantages relating to the details of the blocks will be apparent from a consideration of the following description and the attached drawings. The invention is further pointed out in the claims.

DETAILED DESCRIPTION OF THE PREFERRED EMBODIMENTS

Figure 1:
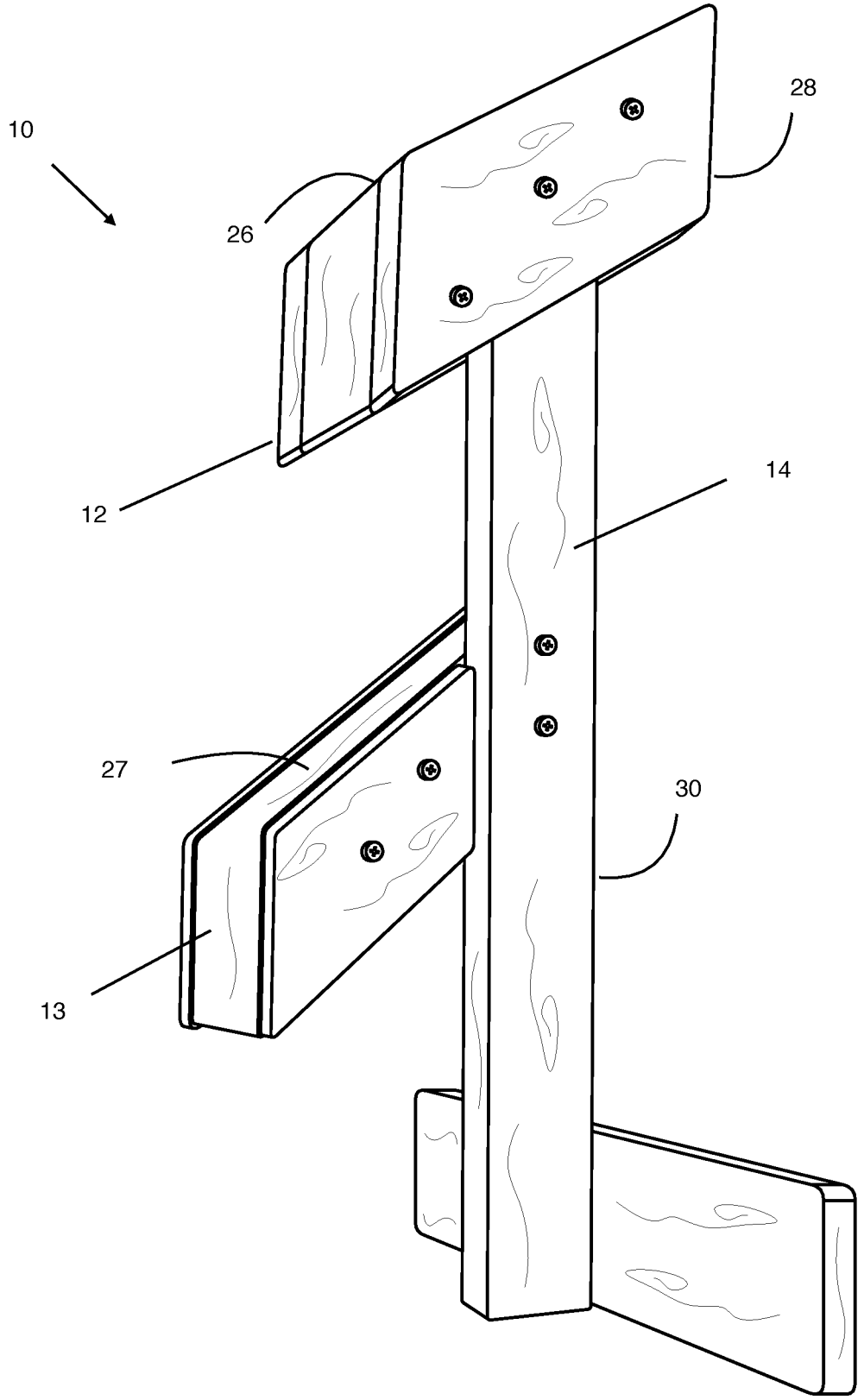
FIG. 1 is a left side perspective view of an embodiment of the invention.
Figure 2:
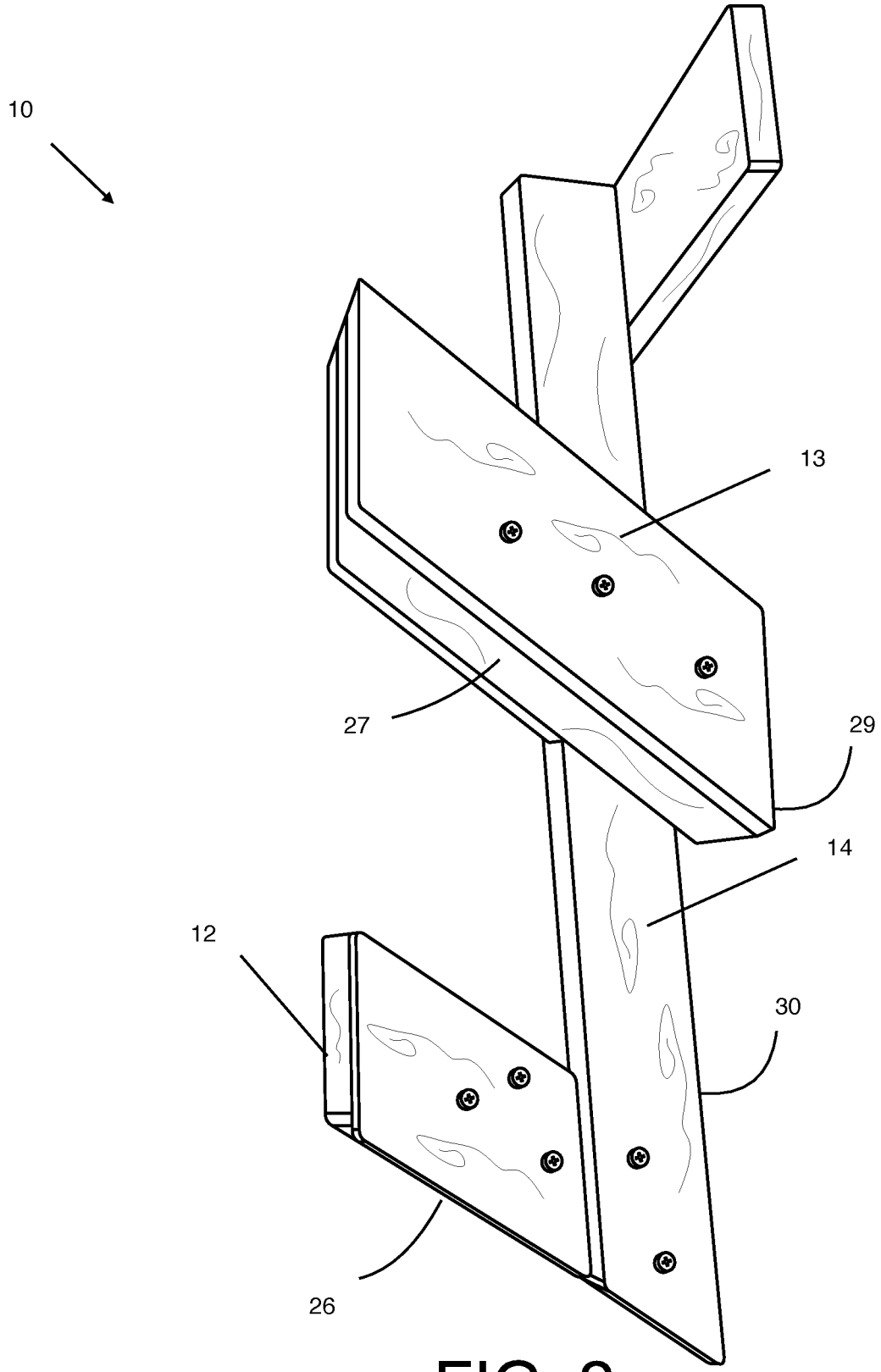
FIG. 2 is a right side perspective view of the invention.
Figure 3:
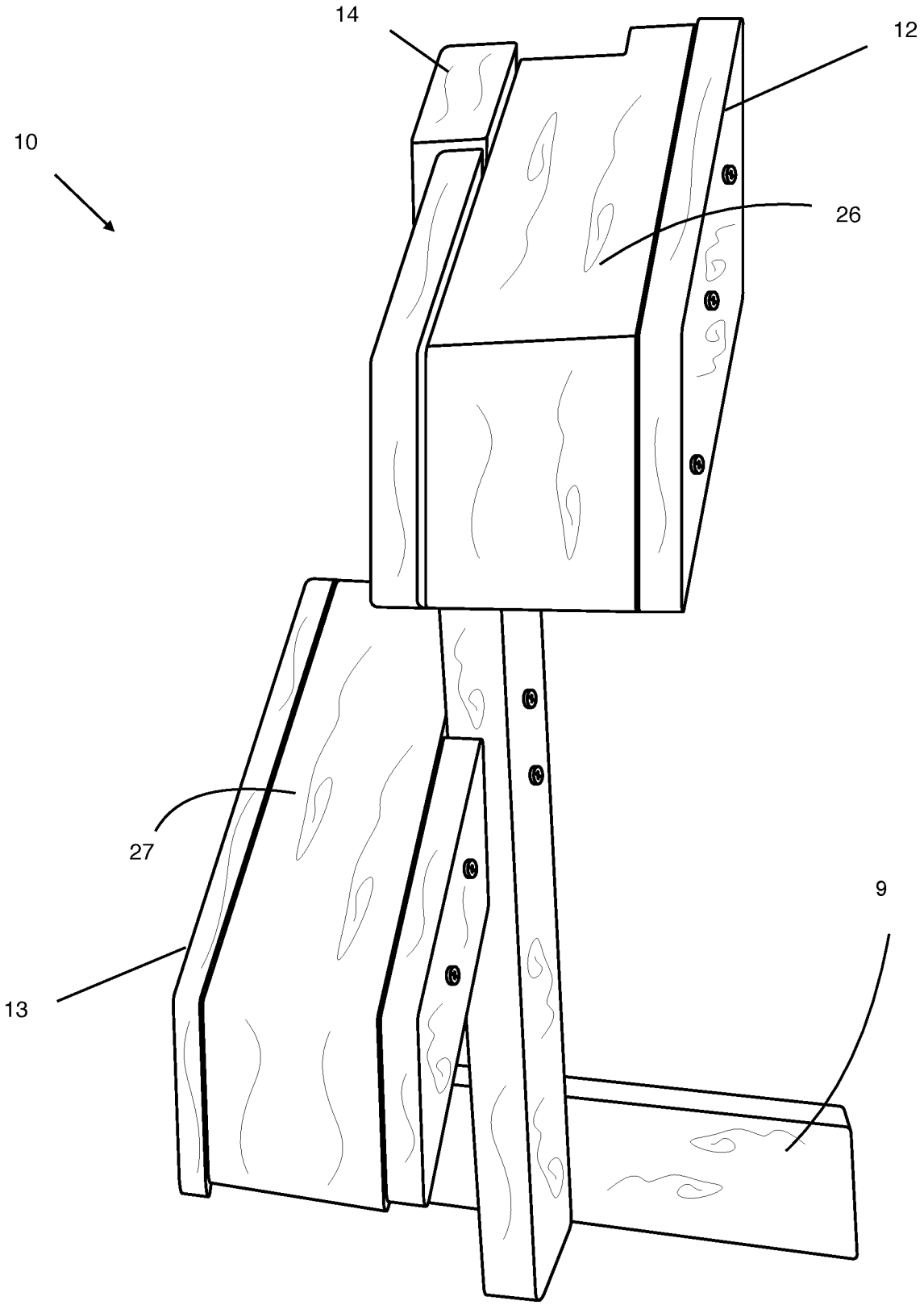
FIG. 3 is a top perspective view of the invention.
Figure 4:
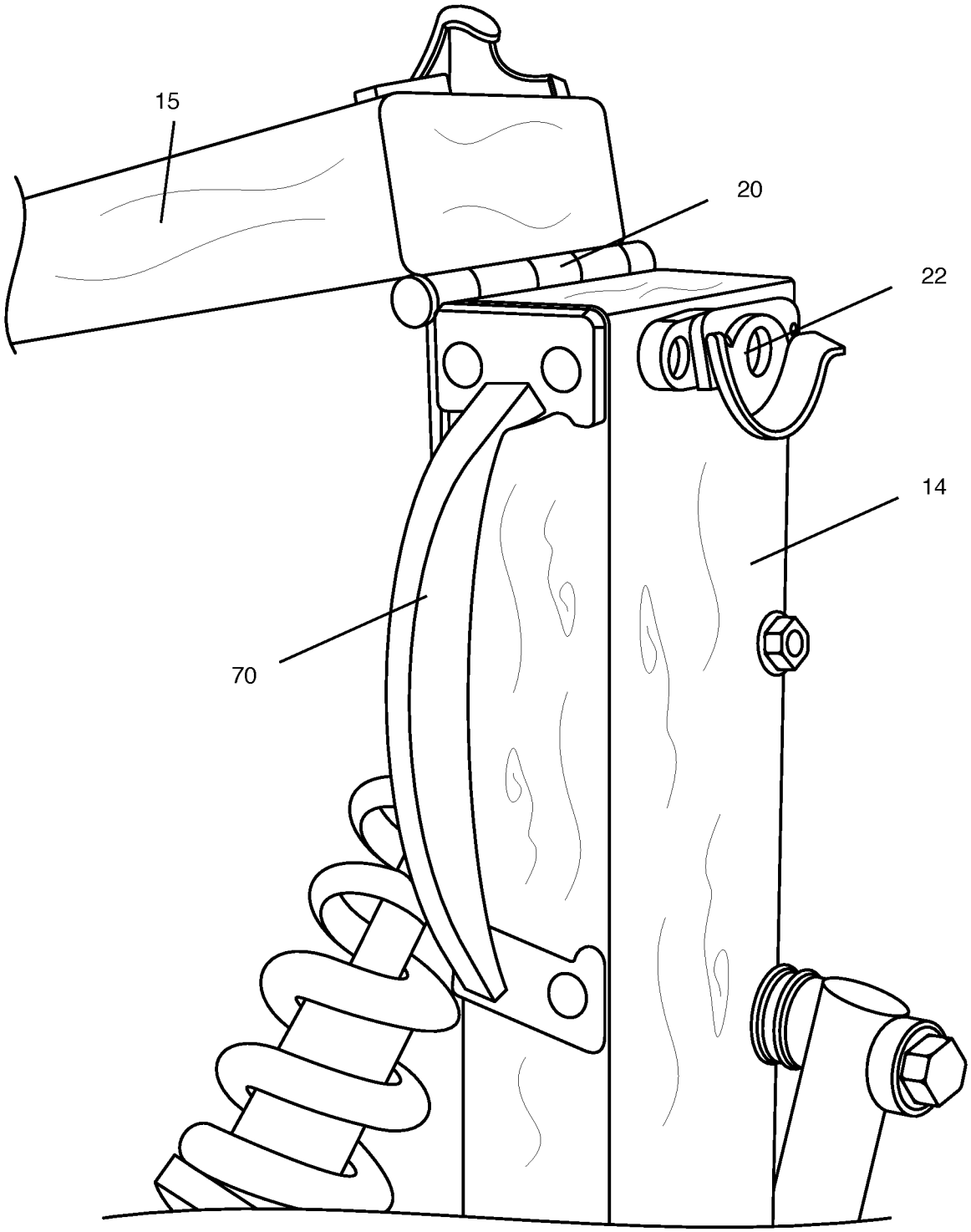
FIG. 4 shows a hinge aspect of the invention.
Figure 5:
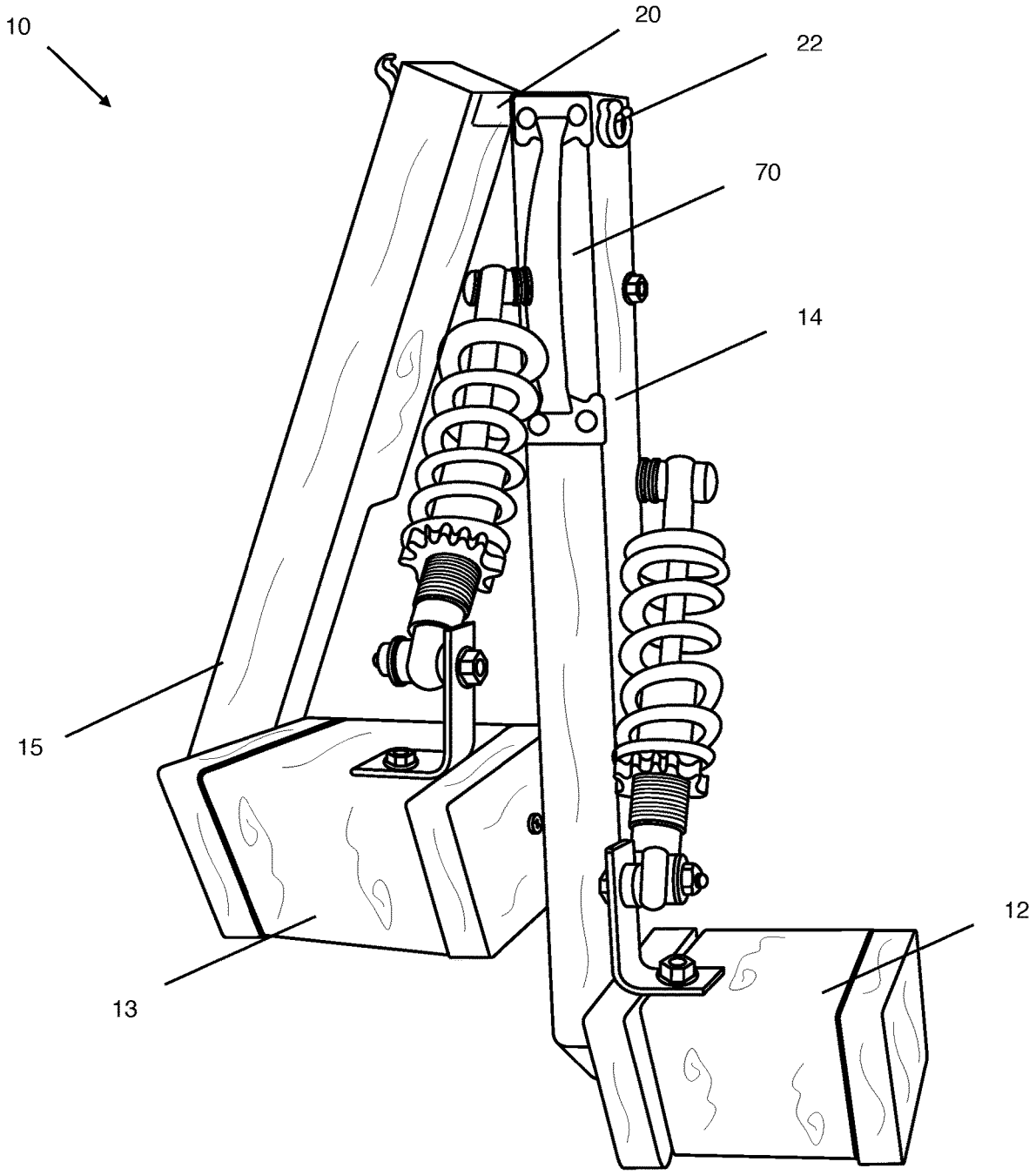
FIG. 5 shows a perspective of another embodiment of the invention in a stored mode.

Referring now to the drawings, a starting blocks device of the present invention is generally referred to by the numeral 10. The invention contemplates several embodiments wherein like parts use like numerals. The starting blocks device 10 includes a forward block 12 removably connected to a forward longitudinal member 14 by way of at least one, preferably two, bolt(s) 16.

A rear longitudinal member 15 is hingedly connected to the forward longitudinal member 14. A transverse member 9 can be provided on the longitudinal member 14 or 15 for stability. A rear block 13 is removably connected to the forward longitudinal member 14 by way of at least one, preferably two, bolt(s) 17. The longitudinal members 14 and 15 can be pivoted into axial alignment about a hinge connection 20 and a locking member 22 can be provided to releasably lock and fix the longitudinal members 14 and 15 in place, i.e., in coaxial alignment. When the longitudinal members 14 and 15 are collapsed the device 10 is easier to handle and store. Additionally, at least one of bolts 16,17 can include a transverse bore 18,19, respectively. Openings 21, and 23 in longitudinal members 14 and 15 enable lock pins 61 and 62 to secure the bolts 16 and 17 and position of the blocks 12 and 13 to the longitudinal members 14 and 15. Additionally, there can be provided an adjustment screw 63 in one abutting end 64 or 65, respectively of either of the longitudinal members 14 and 15, which can be backed out to aid in setting the longitudinal members 14 and 15 in close axial alignment. It is also envisioned there can be a single longitudinal member 14 with both blocks 12 and 13 connected thereto.

Figure 6:
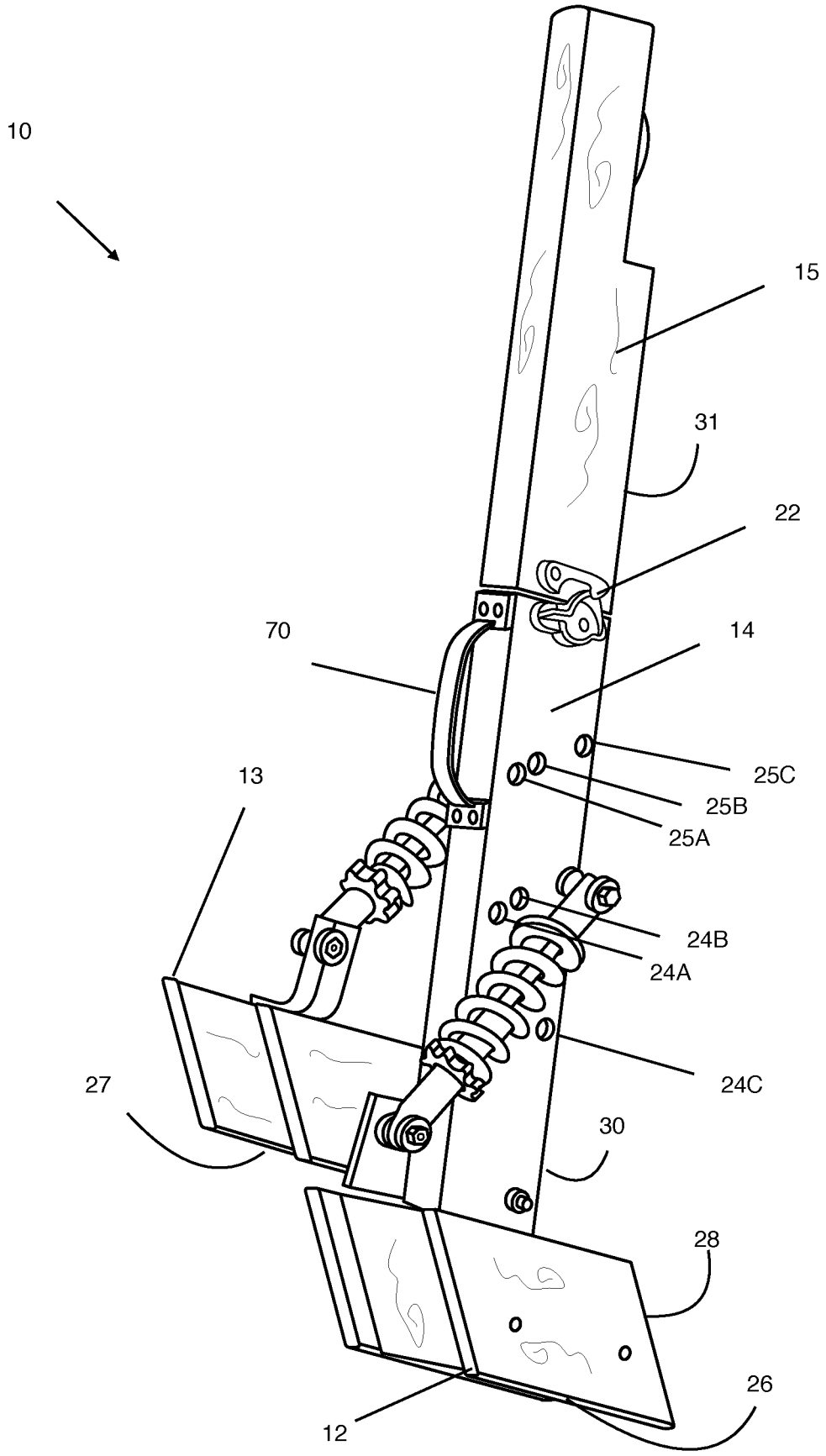
FIG. 6 shows a perspective of the embodiment in FIG. 5 in a deployed mode.
Figure 7:
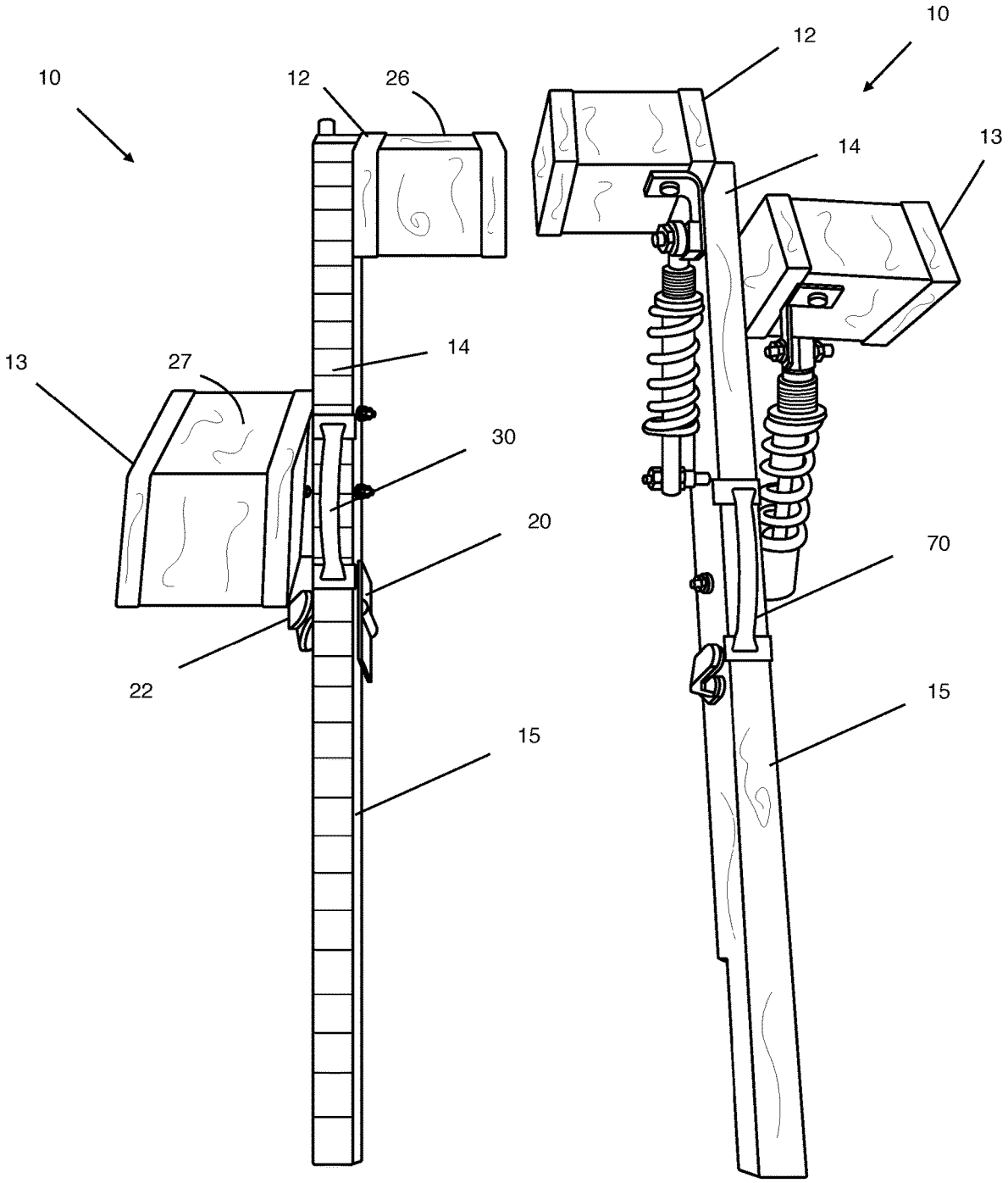
FIG. 7 shows a side by side top perspective of two embodiments of the invention with different block positions.
Figure 8:
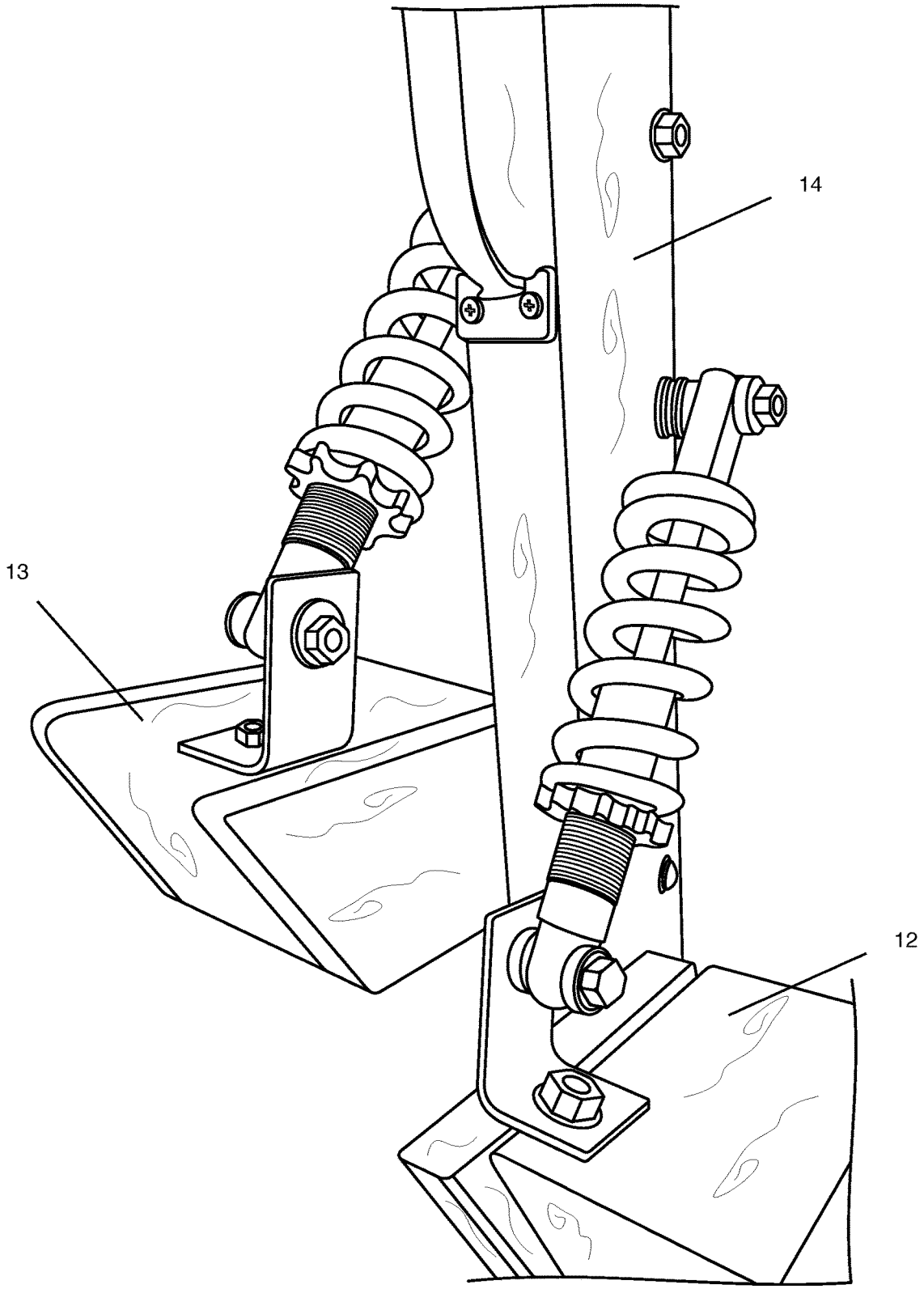
FIG. 8 shows a perspective of spring component of the embodiment in FIG. 5.
Figure 9:
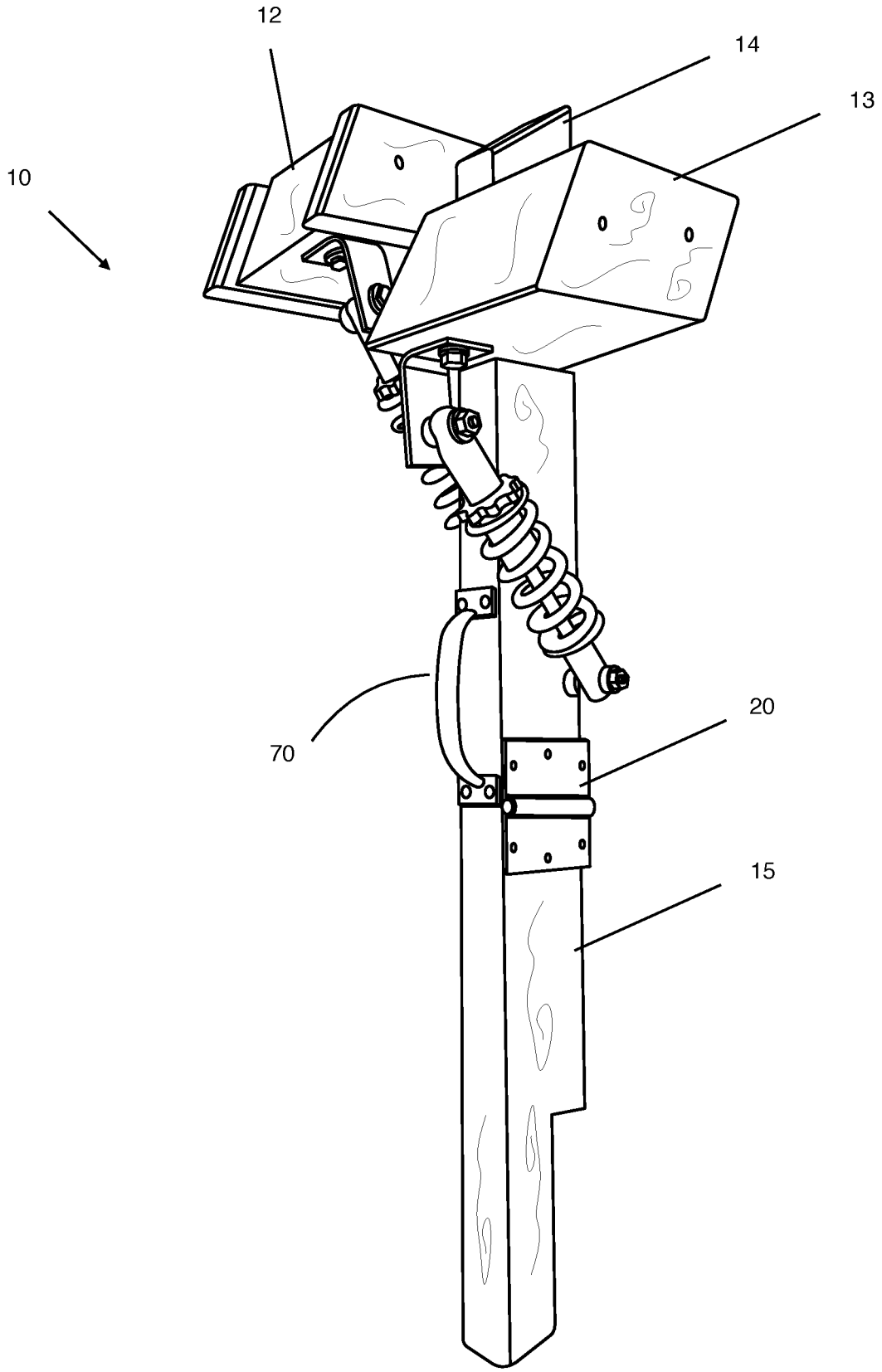
FIG. 9 shows a side perspective of spring component of the embodiment in FIG. 5.
Figure 10:
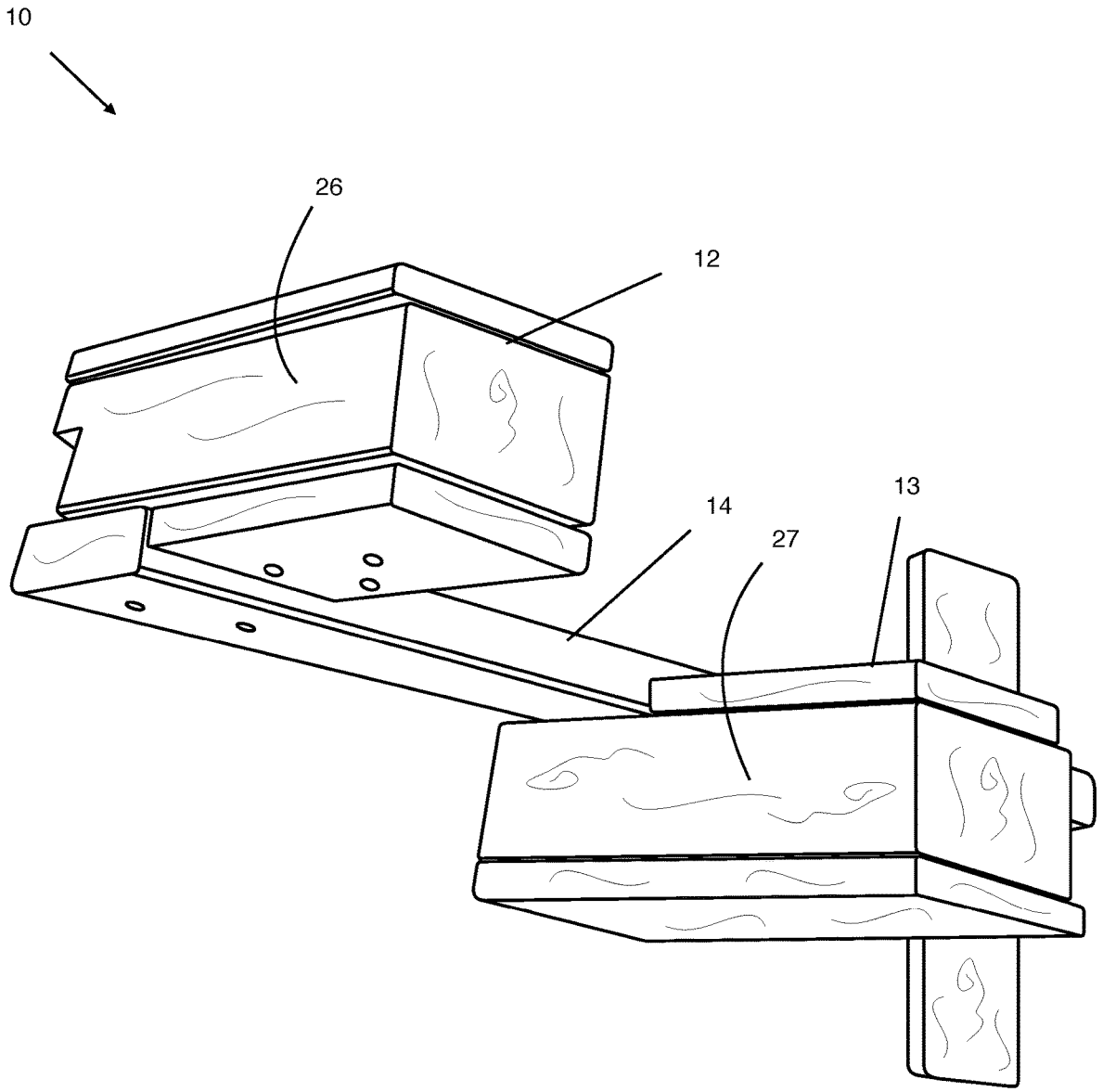
FIG. 10 shows another perspective of the embodiment in FIG. 1.
Figure 11:
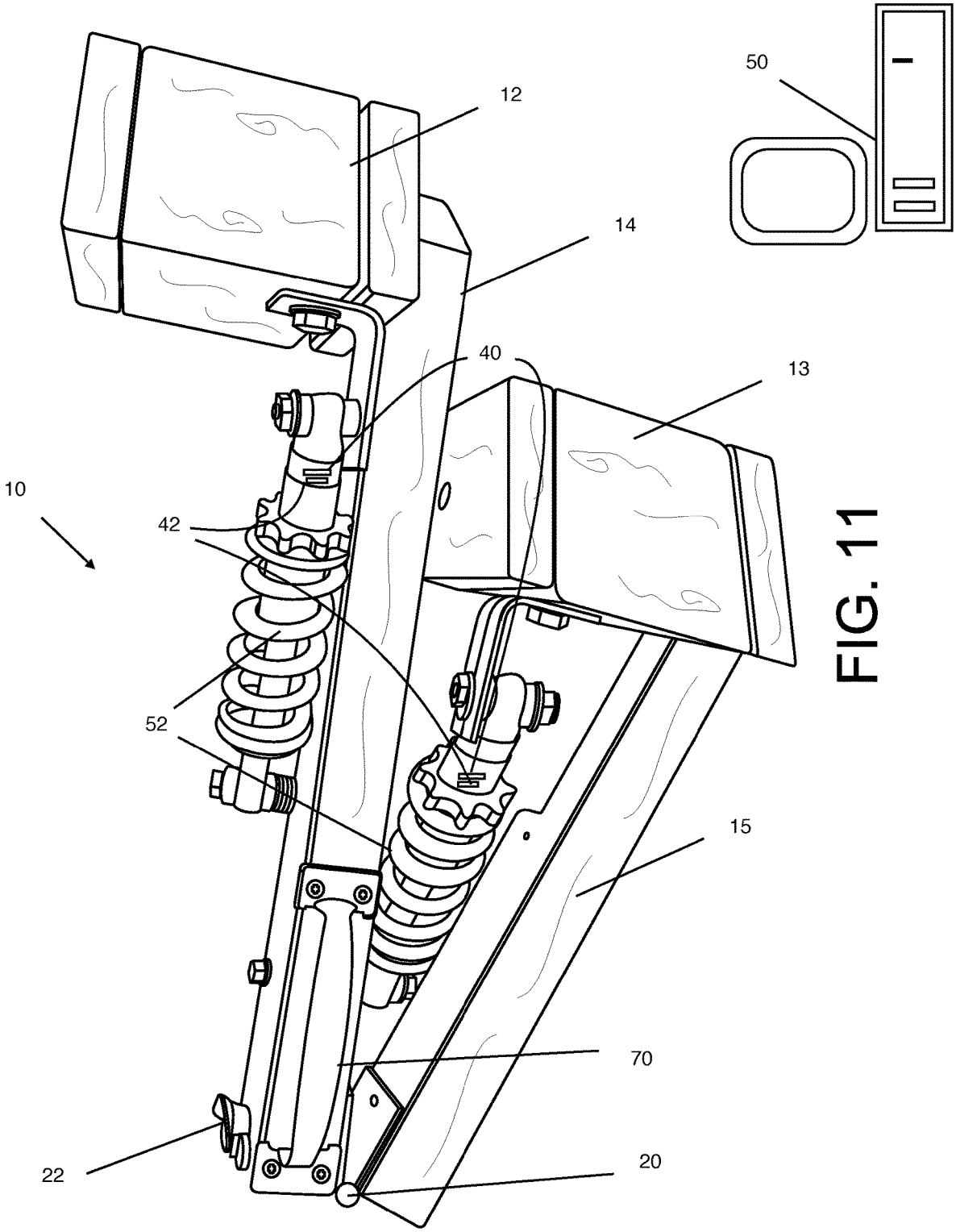
FIG. 11 shows a perspective of FIG. 5.
Figure 12:
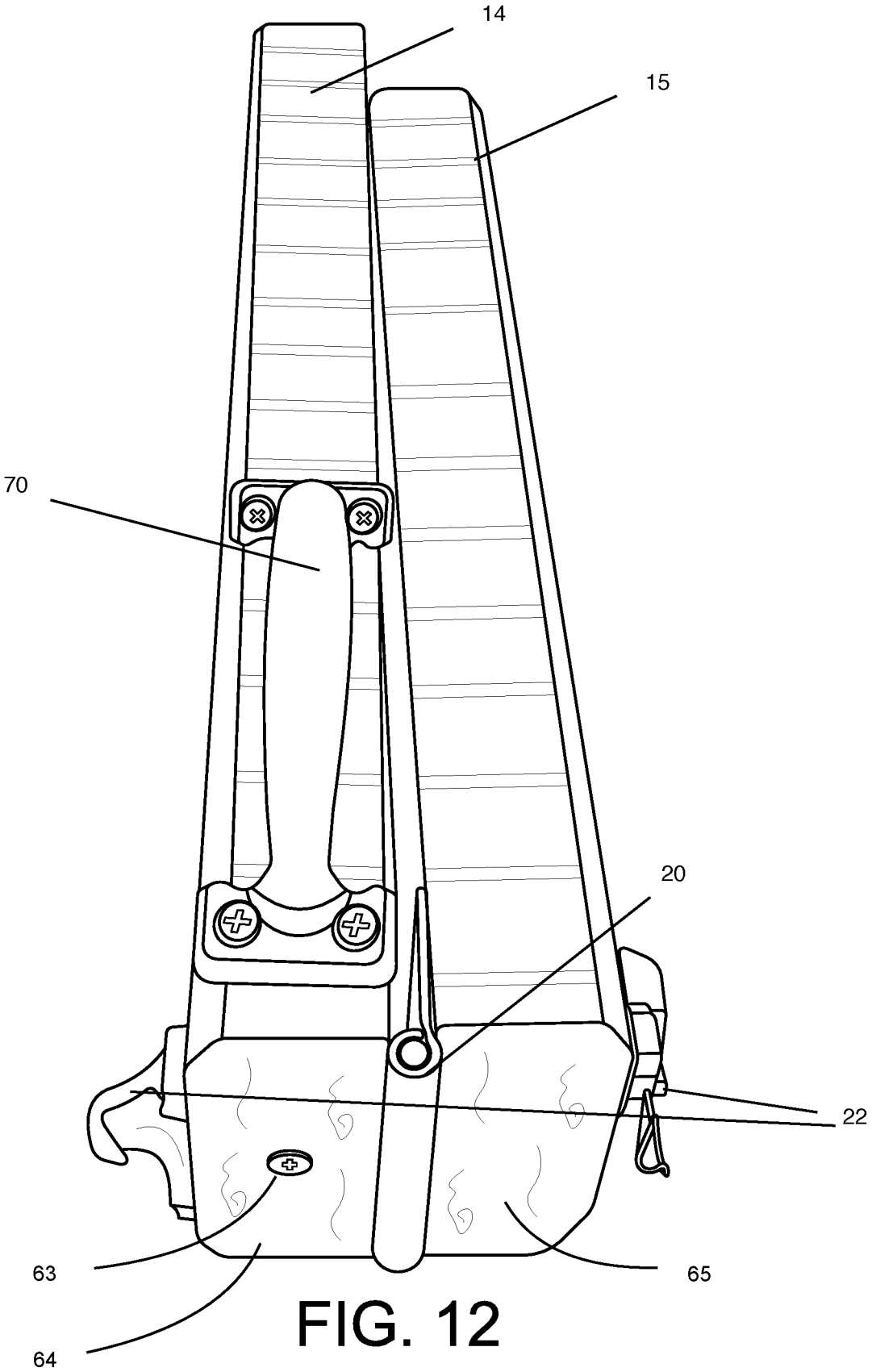
FIG. 12 shows a stored mode of a component of the invention.
Figure 13:
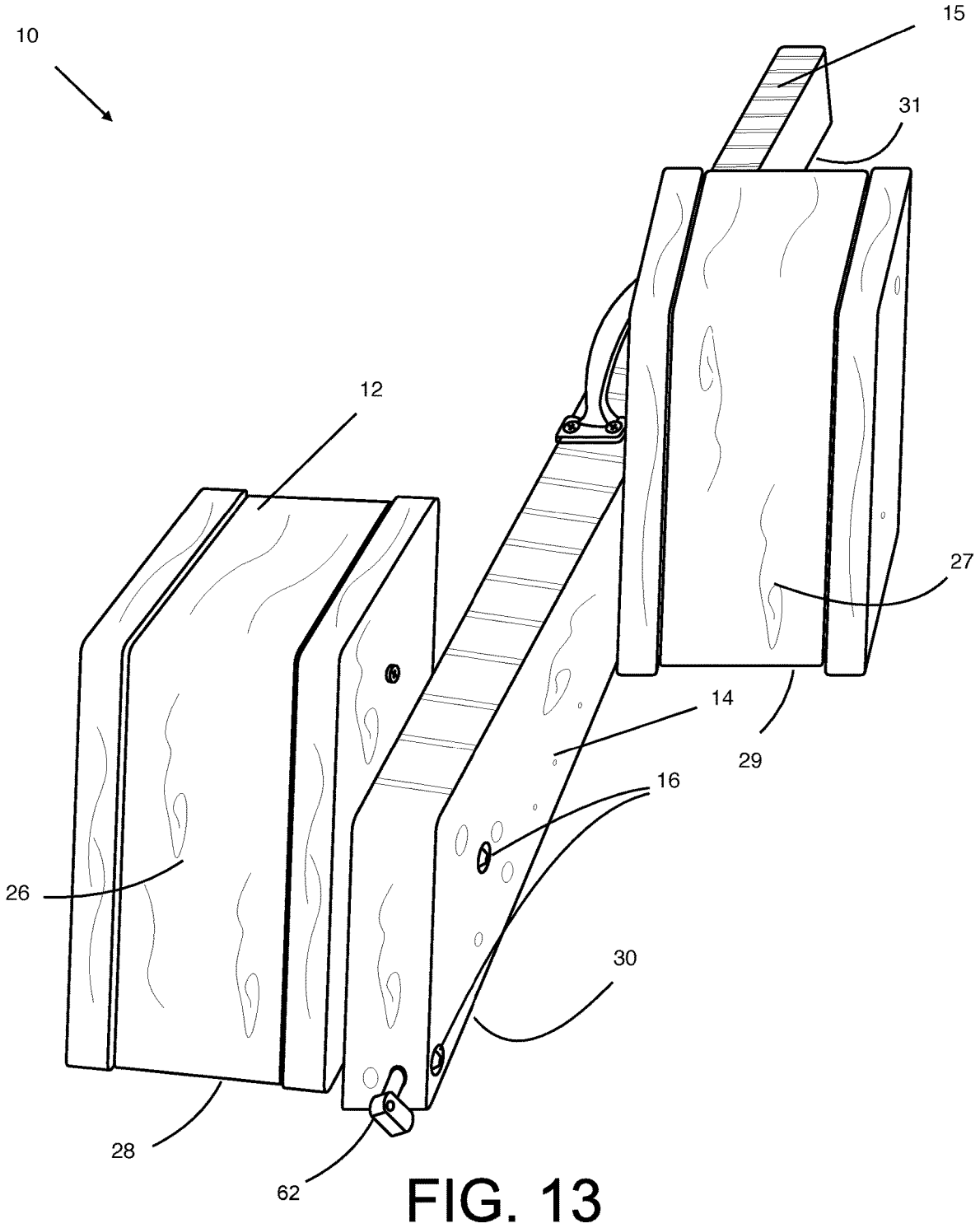
FIG. 13 shows a perspective of a deployed mode of an embodiment of the invention.
Figure 14:
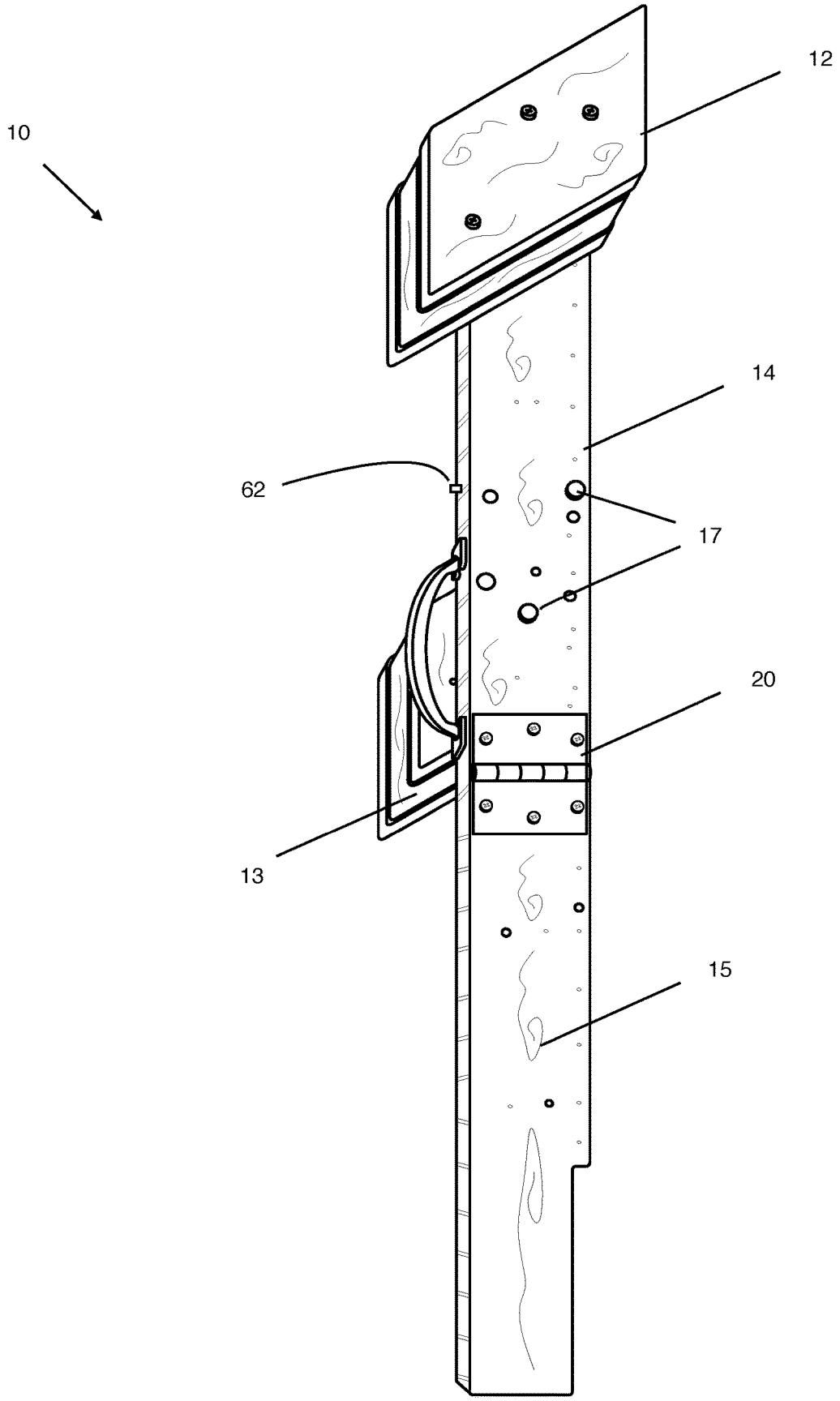
FIG. 14 shows a side perspective of FIG. 13.
Figure 15:
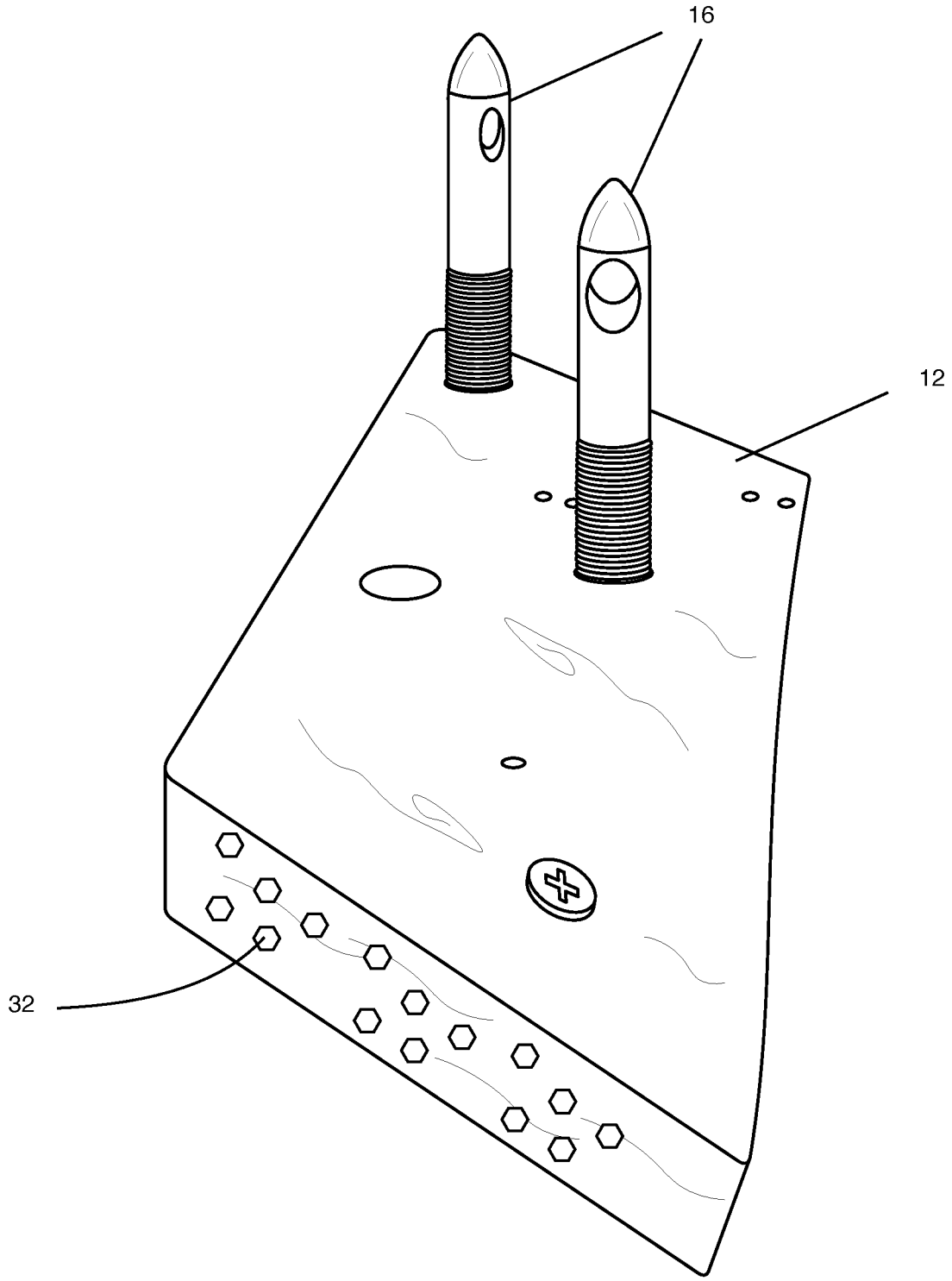
FIG. 15 shows a perspective view of another component of the invention.

As can be seen in FIG. 6, the longitudinal members 14, 15 can include several bolt receiving holes 24A, 24B, 24C, 25A, 25B, 25C such that the bolts 16, 17 can be inserted into a desired set of holes, e.g., 24A-24B or 24A-24C, and 25A-25B or 25A-25C to achieve a desired incline. The number of like formed holes 24 and 25 can be as many as suitable for a desired orientation and some of the like formed holes are not viewable due to assembly of components. Once so oriented, the forward block 12 and rear block 13 have starting faces 26 and 27, respectively, preferably formed with an incline, in which the user sets their feet against. The spaced holes 24 and 25 provide for selectable positioning to conform to the user's preference and variations in the surface of the running track.

A handle 70 can preferably be provided on starting locks device 10. By way of example, the handle is shown on the one of the longitudinal member 14 to assist of carrying the device 10. Each of the blocks 12 and 13 and longitudinal members 14 and 15 has a respective bottom surface 28, 29, 30 and 31 for disposal adjacent a floor or ground surface. Depending on the surface on which the surface is placed, the starting blocks device 10 includes a traction member 32 which can include rubber, plastic or metal in the form of a ridged, spiked or cleated shape on at least one or more of the bottom surfaces 28, 29, 30 and 31 to prevent slippage.

In another embodiment, there is provided pressure sensor 40 can be operably associated with each block 12 and 13 which senses the amount of force a user applies to the block 12 or 13. Additionally, the pressure sensors 40 can provide a signal indicative of the start or reaction time of the user relative to the starting signal of an event. The sensor 40 can be connected to a transmitter 42 which transmits preferably wirelessly a data signal.

A computer based device 50, which includes, a processor, memory, display screen, operating software and application software receives the data signal and transforms this data signal in the application to provide a readout of the sensed pressure/force and start/reaction time data signals displayed on the display screen. It is envisioned that the computer based device can be a desktop or laptop computer, tablet, smart phone or smart watch.

Shock absorbers 52 can be provided on the starting blocks 12 and 13 to assist in the sensing of such pressure/force and start/reaction time. One of each of the shock absorbers 52 is mounted to a back of each block 12 and 13 and a side of the longitudinal member 14 and 15, respectively.

It is generally recognized that track athletes can start faster and achieve better records if they have foot blocks against which they may push in starting a race. It is a purpose of this invention to provide a starting blocks device which can be maintained be used by all track and field athletes for both practice and competition for live and practice events for indoor and outdoor venues.

The above described embodiments are not intended to be limiting, and the claims appended hereto should be entitled to modifications, derivations and improvements reasonably apparent to those skilled in the art. The device 10 may be formed of light wood or other materials as is desired without departing from the theory of our invention.

Having thus described our invention, what I claim as new and desire to secure by Letters Patent is:

1. A starting blocks device, which includes:

a forward longitudinal member having a top side, a bottom side, a left side, a right side, a front end and a back end;

a rear longitudinal member having a top side, a bottom side, a left side, a right side, a front end and a back end, wherein each said longitudinal member has one respective right or left side hingedly connected such that said rear longitudinal member can assume an open position aligned with said forward longitudinal member and provide an expanded support length of said starting blocks device and assume a closed position adjacent but not aligned with said forward longitudinal member providing collapsed portability;

a forward block removably connected to one of said left or right sides of said forward longitudinal member by way of a first bolt;

a handle connected to said top side of said forward longitudinal member for hand held carrying of said starting blocks device; and a rear block is removably connected to one of said left or right sides of the forward longitudinal member rearwardly of said forward block by way of a second bolt.

2. The starting blocks device of claim 1, which includes a pressure sensor on at least one said forward block or said rear block which senses an amount of force a user applies to said block.

3. The starting blocks device of claim 2, wherein said pressure sensor provides a signal indicative of one of start and reaction time of the user relative to a starting signal of an event.

4. The starting blocks device of claim 3, which includes a transmitter operably connected to said pressure sensor for transmitting wirelessly a data signal.

5. The starting blocks device of claim 4, which includes a computer based device having an application for receiving said data signal and transforming said data signal in said application to provide a readout of sensed pressure/force and start/reaction time.

6. The starting blocks device of claim 2, which includes shock absorber on said starting block device to assist in sensing of such pressure/force and start/reaction time.

7. The starting blocks device of claim 1, wherein said forward block or said rear block and said longitudinal forward longitudinal member and said rear longitudinal member have a respective bottom surface for disposal adjacent a subsurface and is equipped with a traction device to prevent slippage.

8. The starting blocks device of claim 7, wherein said traction device includes one of rubber, spiked or cleated material on at least one or more of said bottom surfaces.

9. The starting blocks device of claim 1, which includes a locking device for releasably locking said forward longitudinal member in coaxial alignment with said rear longitudinal member.

10. The starting blocks device of claim 1, wherein each said forward block and said rear block have starting faces formed with one of a fixed and an adjustable incline.

11. A starting blocks device, which includes:

a forward longitudinal member having a top side, a bottom side, a left side, a right side, a front end and a back end;

a rear longitudinal member having a top side, a bottom side, a left side, a right side, a front end and a back end, wherein each said longitudinal member has one respective right or left side hingedly connected;

a handle connected to said top side of said forward longitudinal member for hand held carrying of said starting blocks device;

a forward block removably connected to one of said left or right sides of said forward longitudinal member by way of a first bolt;

a rear block is removably connected to one of said left or right sides of said forward longitudinal member by way of a second bolt; and an adjustment screw in an abutting end of one of said forward longitudinal member and said rear longitudinal member to aid in setting said longitudinal members in close axial alignment.

12. The starting blocks device of claim 11, which includes a pressure sensor on at least one said forward block or said rear block which senses an amount of force a user applies to said block.

13. The starting blocks device of claim 12, wherein said pressure sensor provides a signal indicative of one of start and reaction time of the user relative to a starting signal of an event.

14. The starting blocks device of claim 13, which includes a transmitter operably connected to said pressure sensor for transmitting wirelessly a data signal.

15. The starting blocks device of claim 14, which includes a computer based device having an application for receiving said data signal and transforming said data signal in said application to provide a readout of sensed pressure/force and start/reaction time.

16. The starting blocks device of claim 15, which includes shock absorber on said starting block device to assist in sensing of such pressure/force and start/reaction time.

17. The starting blocks device of claim 11, wherein said forward block or said rear block and said longitudinal forward longitudinal member and said rear longitudinal member have a respective bottom surface for disposal adjacent a subsurface and is equipped with a traction device to prevent slippage.

18. The starting blocks device of claim 17, wherein said traction device includes one of rubber, spiked or cleated material on at least one or more of said bottom surfaces.

19. The starting blocks device of claim 11, wherein each said forward block and said rear block have starting faces formed with one of a fixed and an adjustable incline.

* * * * *